US005715738A

United States Patent [19]

Yetman

[11] Patent Number: 5,715,738

[45] Date of Patent: Feb. 10, 1998

[54] SKATE FOR END CUTTER

[75] Inventor: Robert M. Yetman, Lakeview, N.Y.

[73] Assignee: Eastman Machine Company, Buffalo, N.Y.

[21] Appl. No.: 309,398

[22] Filed: Sep. 20, 1994

[51] Int. Cl.[6] ..... B26D 7/26

[52] U.S. Cl. ..... 83/614; 83/638; 83/650

[58] Field of Search ..... 83/614, 638, 937, 83/649, 650, 56

[56] References Cited

U.S. PATENT DOCUMENTS

| | | | |
|---|---|---|---|
| 3,823,629 | 7/1974 | Bleimund | 83/937 |
| 4,754,674 | 7/1988 | Perlman | 83/614 |
| 4,779,500 | 10/1988 | Bennett et al. | 83/614 |
| 4,960,022 | 10/1990 | Chuang | 83/614 |
| 5,036,740 | 8/1991 | Tsai | 83/614 |
| 5,146,823 | 9/1992 | Holmes | 83/614 |

*Primary Examiner*—Maurina T. Rachuba
*Attorney, Agent, or Firm*—Hodgson, Russ, Andrews, Woods & Goodyear LLP

[57] ABSTRACT

A skate for an end cutter for cutting sheet material such as cloth as the sheet material lies on a supporting surface having opposite sides, the end cutter comprising an elongated track extending across the supporting surface between the sides and having a longitudinal axis, an exposed surface over which the sheet material lies during cutting thereof, a slot extending along the length thereof and a guide surface spaced from the exposed surface facing the slot and extending along the track in a plane substantially parallel to the longitudinal axis thereof. The skate is elongated, slides along the track, and has an operative surface facing the guide surface of the track. A bracket extends from the skate through the slot in the track member, and a blade is carried by the bracket and extends into the slot for cutting sheet material lying on the exposed surface of the track as the skate slide therealong. In accordance with the present invention there is provided at least one movable bearing mounted in the skate on the operative surface thereof for providing bearing contact between the skate and the guide surface of the track as the skate slides along the track. As a result of provision of the movable bearing, friction between the skate and the track is reduced significantly and wear life of the skate and the track is increased significantly.

9 Claims, 5 Drawing Sheets

SKATE FOR END CUTTER

BACKGROUND OF THE INVENTION

This invention relates to apparatus for cutting sheet material such as cloth, and more particularly to a new and improved end cutter having an increased operational life.

In cutting special orders and short lays of sheet material such as cloth, the sheet material is drawn from a supply, such as a roll, along a cutting table, the desired length is cut, the next section is drawn along the table and cut, and this procedure is repeated until the required number of pieces of material have been cut to the same measurement and stacked up. The cutting machine is guided in a direction across the table by a track member which is in the form of an elongated bar having a guide slot therealong through which the blade of the cutting machine travels across the table. As each piece of sheet material is cut, in order to accommodate stacking of the pieces, the track member is lifted after each cut and then returned into contact with the edge of the stack.

In a manual version of the end cutter apparatus, the cutting machine is moved along the track by means of an extended handle, and the track member is raised and lowered by operation of a balanced lifting mechanism for augmenting manually applied force. In an automatic version of the apparatus, movement of the cutting machine along the track and raising and lowering of the track both are self-powered or driven and not in response to application of manual force, such automatic operation being provided, for example, by a controlled belt drive arrangement.

In both manual and automatic versions of the end cutter apparatus, the cutting machine comprises an elongated base plate or skate member which slides along a guide surface extending along within the track below the slot, and a bracket extending from the skate member through the slot for supporting a motor which operates the blade of the cutting machine which extends into the slot. There is wear between the surface of the skate member and the guide surface of the track which affects the useful life of these components of the apparatus. In addition, in the manual version of the apparatus, friction between the skate member and the track guide surface can result in increased fatigue on the human operator's arm in pushing and pulling the handle to move the cutting machine along the track. In the automatic version of the apparatus, friction between the skate member and track guide surface causes wear on the motor and other components of the drive arrangement which moves the cutting machine back and forth along the track. Prior attempts to solve the foregoing problems include providing a layer of anti-fiction material on the surface of the skate member which contacts the track guide surface. However, the surface of the skate member still rubs on the track guide surface, and such rubbing still gives rise to problems such as reduced wear life.

It would, therefore, be highly desirable to provide an improved skate for an end cutter wherein friction between the skate member and the track member is reduced significantly and wherein the wear life of the skate member and track member is increased significantly.

SUMMARY OF THE INVENTION

It is, therefore, a primary object of this invention to provide a new and improved skate member for an end cutter apparatus for cutting sheet material such as cloth.

It is a further object of this invention to provide a skate member which has significantly reduced friction with the track member of such end cutter apparatus.

It is a further object of this invention to provide such a skate member which along with the track member of such end cutter apparatus has an increased wear life.

It is a more particular object of this invention to provide such a skate member which improves the wear life of the end cutter apparatus of which it is a part.

The present invention provides an improved skate means for an end cutter for cutting sheet material such as cloth as the sheet material lies on a supporting surface having opposite sides, the end cutter comprising elongated track means adapted to extend across the supporting surface between the sides and having a longitudinal axis, an exposed surface over which the sheet material lies during cutting thereof, a slot extending along the length thereof and a guide surface spaced from the exposed surface facing the slot and extending along the track means in a plane substantially parallel to the longitudinal axis thereof. The skate means is elongated, slides along the track means, and has an operative surface facing the guide surface of the track means. A bracket extends from the skate means through the slot in the track member, and a blade is carried by the bracket and extends into the slot for cutting sheet material lying on the exposed surface of the track means as the skate means slides therealong. In accordance with the present invention there is provided movable bearing means mounted in the skate means on the operative surface thereof for providing bearing contact between the skate means and the guide surface of the track means as the skate means slides along the track means. As a result of provision of the movable bearing means, friction between the skate means and the track means is reduced significantly and wear life of the skate means and the track means is increased significantly.

The foregoing and additional advantages and characterizing features of the present invention will become clearly apparent upon a reading of the ensuing detailed description together with the included drawing wherein:

BRIEF DESCRIPTION OF THE DRAWINGS FIGURES

DETAILED DESCRIPTION OF THE ILLUSTRATED EMBODIMENTS

Figure 1:
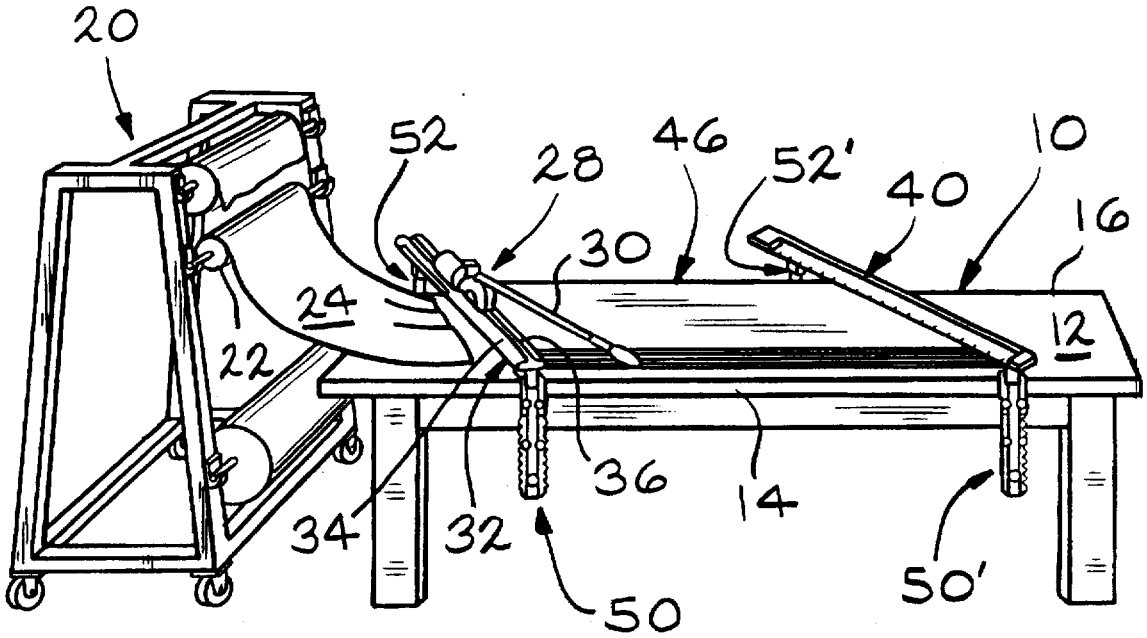
FIG. 1 is a perspective view of a manual version of end cutter apparatus for cutting sheet material such as cloth and including the improved skate according to the present invention.

FIG. 1 shows end cutter apparatus of the manual type as it would appear in use with a cutting table, feed roll supply and arrangement for cutting cloth or similar sheet material in special orders or short lays of material. A conventional cutting room table 10 has a planar supporting surface 12, usually disposed in a horizontal plane, and has a pair of substantially parallel opposite sides 14 and 16 extending along the length thereof. The cloth or similar sheet material is supplied and fed from various suitable arrangements, such as the illustrative rack 20 rotatably supporting a plurality of rolls, for example roll 22, with a portion 24 of the cloth or sheet material being fed onto surface 12. For cutting the cloth material there is shown an end cutter generally designated 28 in the form of a round knife machine having an extended handle 30 together with a track 32 for guiding the knife in a direction across the surface 12 through the cloth. The track has an exposed surface 34 over which the cloth lies and slot 36 extending therealong for guiding travel of the blade of cutter 28. By way of example, the end cutter 28 with or without the track 32 is commercially available from Eastman Machine Company under the designation Falcon End Cutter.

In use, track 32 is positioned at the desired location on surface 12 and at the desired angle relative to the longitudinal axis of surface 12. The specified length for each piece of cloth or sheet material to be cut and stacked up is measured from slot 36 toward the opposite end of surface 14 and marked, such as by a cloth alignment bar 40 or other suitable means. The cutter 28 is moved by the operator using handle 30 along track 32 to the rear or starting position which is adjacent the far edge 16 of surface 12 as viewed in FIG. 1. Then the cloth or sheet material 24 is drawn from the roll 22 or otherwise fed onto the surface 12 over the surface 24 of track 32 and further along surface 12 to cloth alignment bar 40 or other suitable means for marking and maintaining the position of the cloth at the far end. The operator then pulls cutter 28 by handle 30 along slot 32 and across surface 12 to cut the material into one piece and then cutter 28 is returned to the rear position. At this point, track 32 is lifted by the mechanisms 50,52 so that the adjacent edge of the cut piece of material falls under the track 32 for stacking whereupon track 32 is lowered by mechanisms 50,52 and returned into contact with the edge of the stack. Similarly, when cloth alignment bar 40 is used, it likewise is lifted by mechanisms 50',52' so that the adjacent edge is thereunder during stacking whereupon bar 40 is lowered by mechanisms 50',52' to return bar 40 into contact with the edge of the stack. The lifting mechanism 50,52 and 50',52' form no part of the present invention. Upon conclusion of the foregoing operation, the arrangement is ready for cutting the next piece to be accumulated in the stack. In FIG. 1 a stack 46 of cut pieces is shown with the opposite end edges under track 32 and alignment bar 40, and the sheet of material is drawn over along the top of the stack as each successive cut is made. For a more detailed description of the apparatus shown in FIG. 1 reference may be made to U.S. Pat. No. 4,553,328 issued Nov. 19, 1985 entitled "Guided Lifting Apparatus" and assigned to the assignee of the present invention, the disclosure of which is hereby incorporated by reference.

Figure 2:
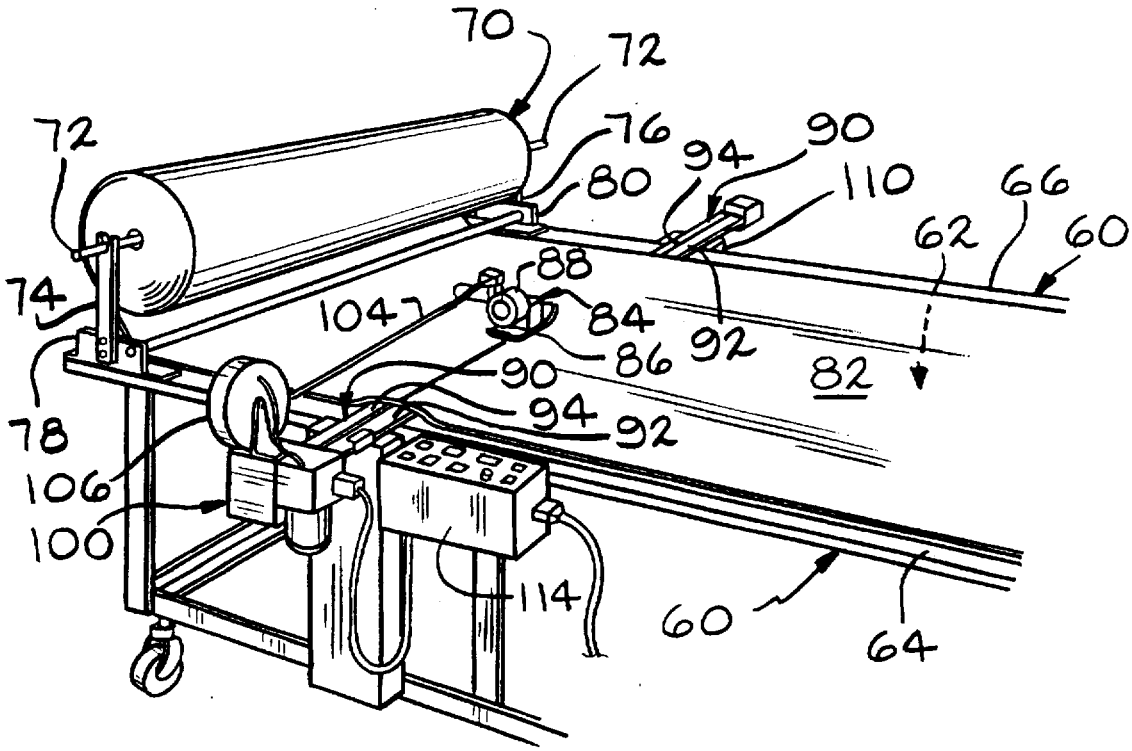
FIG. 2 is a perspective view of an automatic version of end cutter apparatus for cutting sheet material such as cloth and including the improved skate according to the present invention.

FIG. 2 shows end cutter apparatus of the automatic type and, as in the case of the apparatus of FIG. 1, a conventional cutting room table 60 has a planar supporting surface 62 with substantially parallel opposite edges 64 and 66 extending along the length thereof. The cloth or similar sheet material is supplied and fed from various suitable arrangements, such as a conventional supply roll 70 wound on a rod or shaft 72 rotatably supported by a pair of spaced apart upstanding arms 74 and 76 fixed to brackets 78 and 80, respectively, near one end of table 60. The supply roll 70 is shown with a portion 82 of the cloth or sheet material being fed onto surface 62. For cutting the cloth material 82 there is shown an automatic end cutter generally designated 84 in the form of a round knife machine comprising a presser foot 86, motor 88 and blade (not shown in FIG. 2). Cutter 84 is commercially available from Eastman Machine Company under the designation Falcon End Cutter. The cutter 84 is guided across the supporting means or table 60 for cutting cloth 82 by track means 90 in the form of an elongated bar having a hollow interior and which extends across table 60 substantially perpendicular to the longitudinal axis of the table, i.e. perpendicular to sides 64,66. Track 90 has an exposed surface 92 over which the sheet material or cloth lies and a slot 94 extending longitudinally thereof for guiding travel of the blade of cutter 84.

The automatic end cutter apparatus of FIG. 2 further comprises drive means generally designated 100 located at one end of track means 90 and a coupling arrangement such as belts (not shown) extending along the hollow track 90 for drivingly coupling cutter 84 to drive means 100 for moving cutter 84 in opposite directions along track 90. In particular, cutter 84 is moved first in one direction, i.e. the forward direction away from drive means 100 as viewed in FIG. 2, across the entire width of sheet 82 for cutting the same and then is moved in the opposite direction to a return position near drive means 100 in preparation for the next cut. Electrical power for operating cutter 84 is supplied by a conductor 104 wound or otherwise stored in a reel 106. Supporting means 108,110 at opposite ends of track means 90 each include an arrangement to raise and lower the track 90 relative to the surface 62 of table 60 in a controlled manner automatically in response to operation of drive means 100 through a suitable coupling such as belts (not shown) extending along the hollow track 90. A control means 114 provides control of drive means 100 and cutter 84. The drive means 100, supporting means 108,110 and control means 114 form no part of the present invention, the disclosure of which is hereby incorporated by reference.

In use, the only work required by the human operator is pulling material from roll 70 and operating switches on control means 114. Thus, the operator simply grasps the end of the portion 82 of cloth to draw it from supply reel 70 along supporting surface 62 and over track 90. Then he operates a switch on control means 114 which starts a cycle causing drive means 100 to move cutter 84 first in a forward direction along track 90 to cut the cloth 82 and then return for the next cut during which return the control causes drive means 100 to operate arrangements in supporting means 108,110 to raise and then lower track 90 for stacking of the cut section of cloth 82. The machine remains in a rest condition waiting for the next cut. The operator then simply pulls more material from roll 70 over track 90 and operates the same switch on control means 114 resulting in an identical cutting cycle including raising and lowering of track 90. The foregoing is repeated for the required number of cut sections of cloth, the cut sections being stacked on table 60 adjacent track 90. For a more detailed description of the apparatus shown in FIG. 2, reference may be made to U.S. Pat. No. 4,779,500 issued Oct. 25, 1988 entitled "Automatic End Cutter" and assigned to the assignee of the present invention, the disclosure of which is hereby incorporated by reference.

Figure 3:
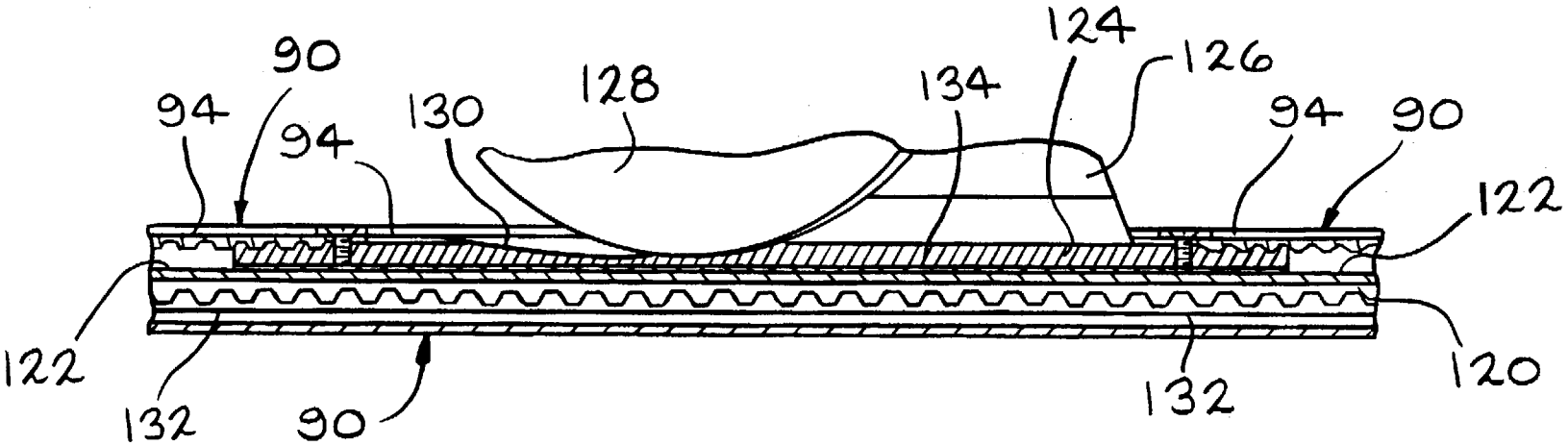
FIG. 3 is a fragmentary sectional view showing an end cutter skate to which the present invention is applicable.

In both the manual end cutter version shown in FIG. 1 and the automatic end cutter version of FIG. 2, the cutting machine comprises an elongated base plate or skate member which slides along a guide surface extending along within the track member below the slot, and a bracket extending from the skate member through the slot for carrying the blade of the cutting machine which extends into the slot. The present invention is directed to the problem of friction between the skate member and the guide surface of the track. By way of further background, the skate member of the automatic end cutter of FIG. 2 is shown in FIG. 3, it being understood that the skate member of the manual end cutter version of FIG. 1 is substantially the same. Referring to FIG. 3, the hollow interior of track 90 includes an internal guide member 120 which extends along the track in a plane substantially parallel to the longitudinal axis of track 90. Member 120 has a guide surface 122 which faces the slot 94 in track 90. An elongated base plate or skate member 124 of the cutting machine slides along guide surface 122 of track 90. A bracket 126 extends from skate 124 through slot 94 in track 90 where it serves to support the motor 88 (not shown in FIG. 3) of the cutting machine which operates a blade 128 which extends into the slot 94 of the track. An arcuate recess 130 is provided in the upper surface of skate 124 to accommodate blade 128. Also shown in FIG. 3 is a portion of the belt 132 which is operated by drive means 100 to move the cutting machine along track 90. An example of a prior art approach to reducing friction between skate 124 and guide surface 122 is a layer or sheet 134 of anti-friction material such as Teflon or Turcite applied to the surface of skate 124 which faces and contacts guide surface 122. However, there still is the entire surface area of skate 124 in rubbing or sliding contact with guide surface 122.

In accordance with the present invention, there is provided movable bearing means mounted in the skate on the operative surface thereof for providing bearing contact between the skate and the guide surface of the track as the skate slides along the track. The term movable bearing means is meant to include a bearing structure which includes as least one movable component such as a ball, cylinder or the like and which bearing structure when provided or installed in the operative surface of the end cutter skate provides bearing contact between the skate and the guide surface of the elongated track member of the end cutter apparatus.

Figure 4:
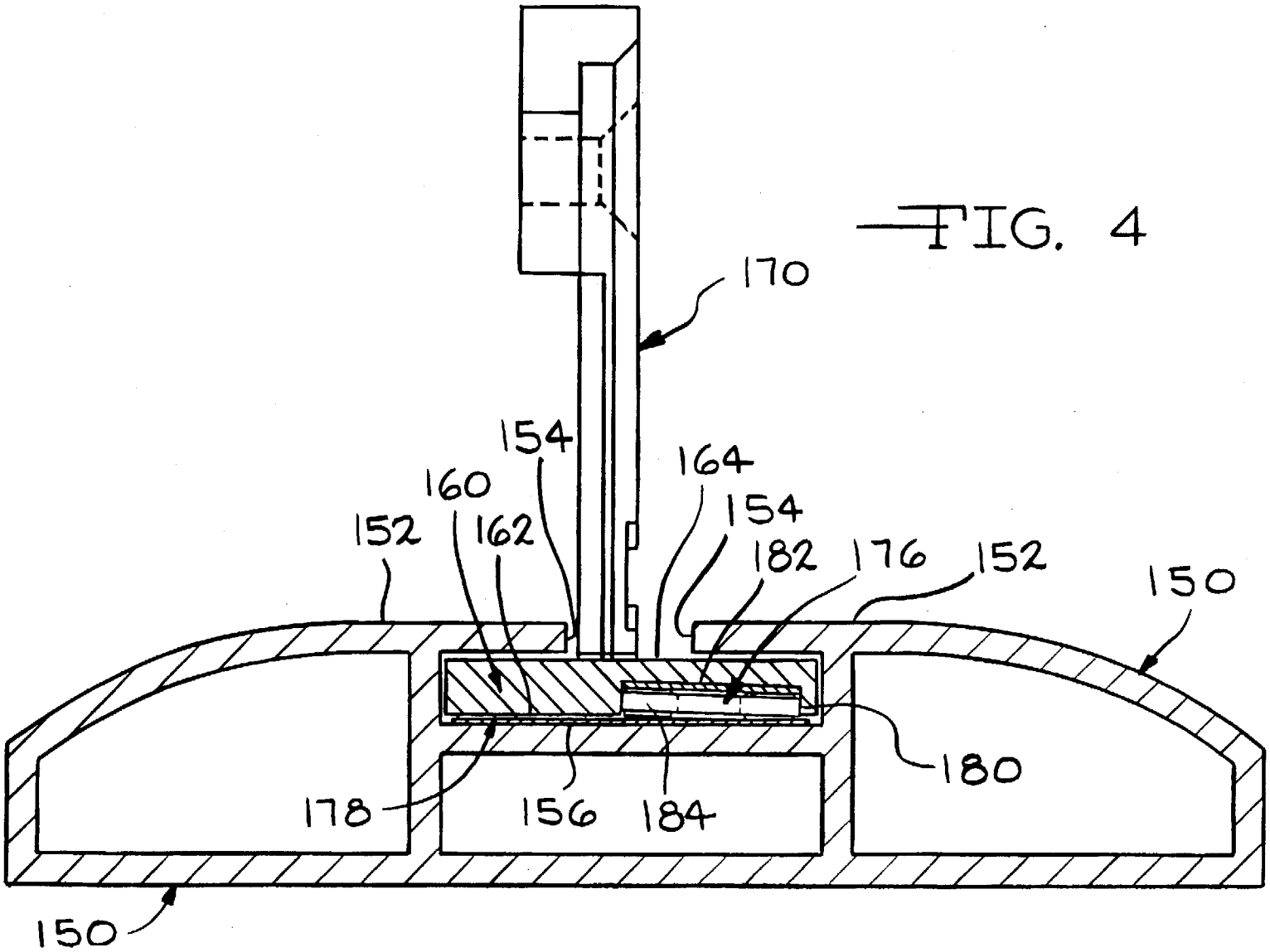
FIG. 4 is a sectional view with parts removed of an improved skate for both manual and automatic end cutters according to the present invention.
Figure 5:
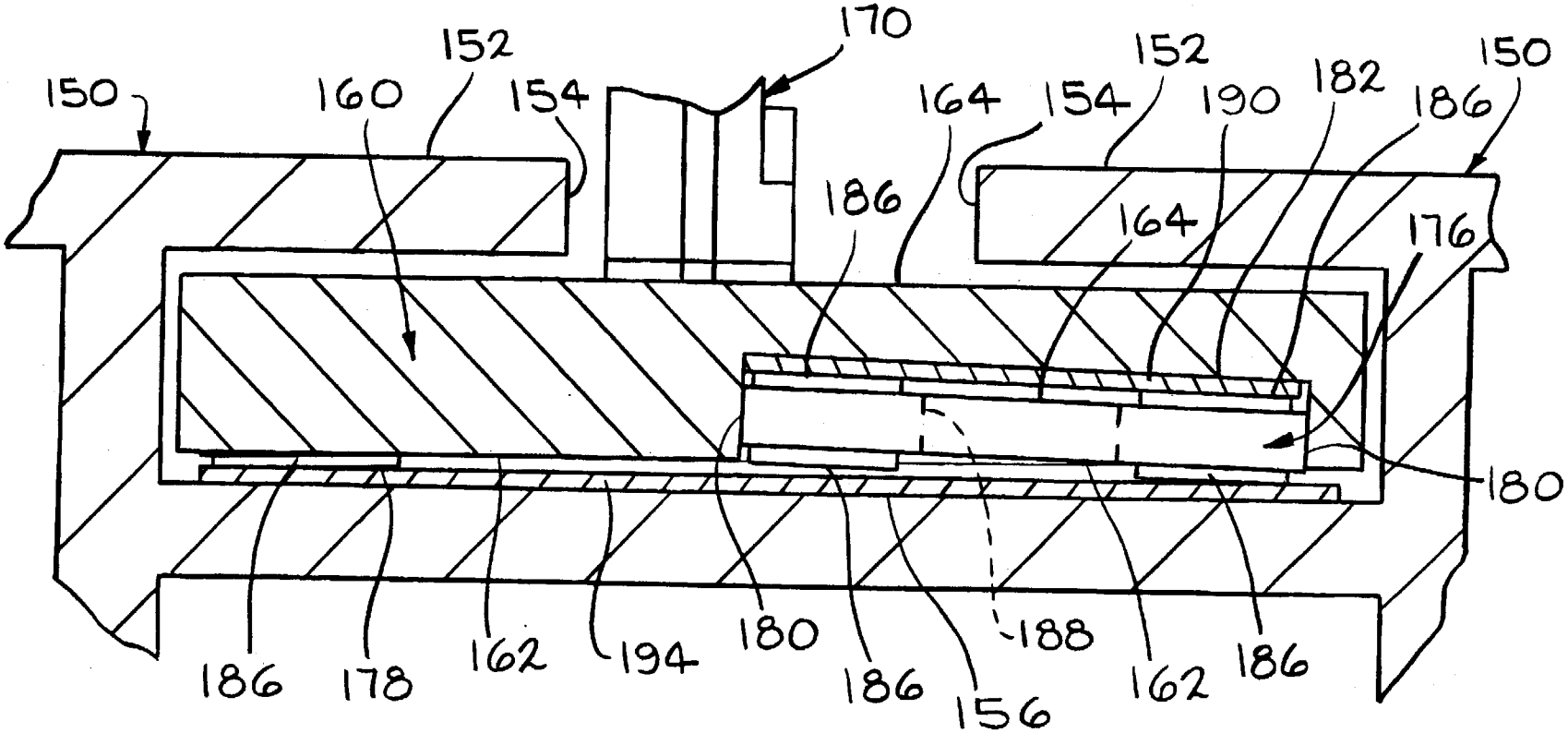
FIG. 5 is an enlarged view of a portion of FIG. 4 further illustrating the improved skate according to the present invention.

Referring now to FIG. 4 and the enlargement of FIG. 5, there is shown a track means generally designated 150 which is the same as tracks 32 and 90 in the arrangements of FIGS. 1 and 2, respectively. Track means 150, like the tracks previously described, is elongated having a longitudinal axis which is perpendicular to the plane of the paper as viewed in FIGS. 4 and 5, is adapted to extend across the supporting surface of the cloth cutting apparatus between the sides thereof, and has an exposed surface 152 over which the sheet material lies during cutting thereof, a slot 154 extending along the length of track 150 and a guide surface 156 spaced from the exposed surface 152 and facing slot 154 and extending along track 150 in a plane substantially parallel to the longitudinal axis thereof. An elongated, substantially rectangular base plate or skate means 160 slides along track means 150 in a manner similar to skate 124 shown and described in connection with FIG. 3. Skate means 160 has an operative surface 162 which faces guide surface 156 of track means 150 and has another, oppositely disposed surface 164 which faces slot 154. A bracket means generally designated 170 extends from skate means 160 through the slot 154 in track 150. In particular, bracket 170 is fixed at one end, i.e. the lower end as viewed in FIG. 4, to surface 164 of skate 160. A disc-shaped blade means (not shown) similar to blade 128 of FIG. 3 is carried by the other end of bracket 170, i.e. the upper end as viewed in FIG. 4, and extends into slot 154 for cutting sheet material lying on the exposed surface 152 of track 150 as skate 160 slides therealong.

Figure 6:
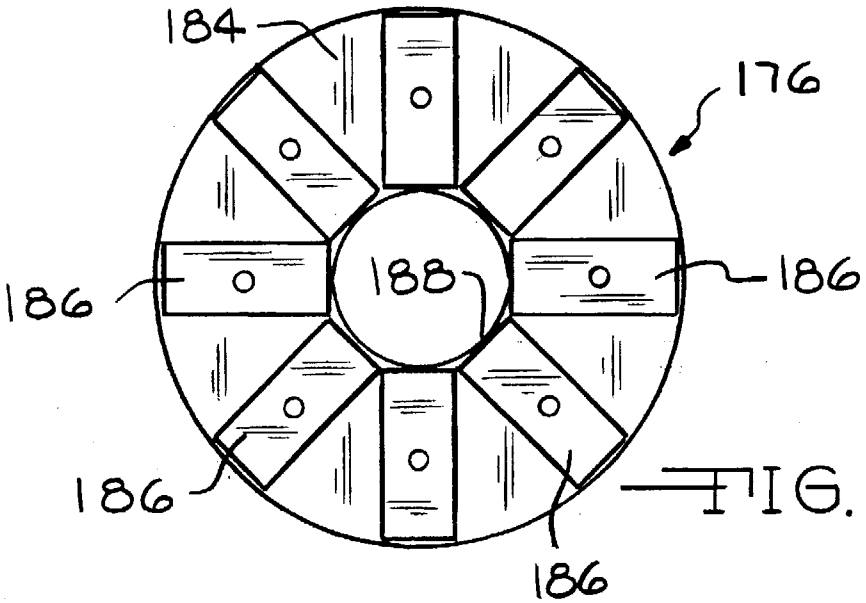
FIG. 6 is an elevational view of one of the bearing means in the end cutter skate of FIGS. 4 and 5.

In accordance with the present invention, there is provided bearing means generally designated 176 in the operative surface 162 of skate means 160 for providing bearing contact between skate means 160 and the guide surface 156 of track means 150 as the skate means 160 slides along the track means 150. As will be shown in detail presently, preferably a plurality of bearing means are provided in spaced relation along skate operative surface 162, in particular in pairs at the ends of skate 160, and another one of the bearing means is indicated at 178 in FIGS. 4 and 5. In accordance with a preferred mode of the present invention, each of the bearing means is a needle roller thrust bearing which, as will be shown and described in further detail presently, comprises a disc-shaped body and a plurality of rollers extending radially outwardly from the center of the body and rotatable therein. Each bearing means is mounted in skate 160 in the following manner. A circular recess 180 is provided in skate surface 162, preferably between the central longitudinal axis of skate 160 and one of the side edges thereof, and has a circular inner surface 182. Bearing means 176 comprises a disc-shaped body or housing 184, and the diameter of recess 180 is of a size providing a proper fit of body 184 therein. As shown in FIG. 6, bearing means 176 includes a plurality of cylindrical rollers, each designated 186, rotatably mounted in body 184. Rollers 186 extend radially outwardly from a central opening 188 in body 184 and are spaced circumferentially therearound.

As shown in FIG. 5, preferably a wear disc 190 is placed in recess 180 in contact with surface 182 and the rollers 186 of bearing means 176 contact disc 190. Track means 150 can be equipped with wear strip 194 on guide surface 156 and extending therealong in which case rollers 186 of bearing means 176 have bearing contact with wear strip 194. Otherwise, rollers 186 have bearing contact with guide surface 156 if wear strip 194 is not provided. Wear disc 190 can be held in place by applying grease between disc 190 and housing surface 182. Bearing means 176 can be held in place by applying grease between bearing housing 180 and disc 190. In addition, grease which collects in central opening 188 of bearing housing 180 collects particulate contaminants and keeps them away from the bearing rollers 186.

Bearing means 176 is disposed in skate means 160 so that the axis of bearing means 176 which coincides with the center of opening 188 is disposed at a slight angle with respect to a line perpendicular to guide surface 156. In other words, a plane passing through body 184 of bearing means 176 and perpendicular to the aforementioned axis of bearing means 176 is disposed at a slight angle of inclination with respect to guide surface 156. The slight upward inclination is in a direction from the outer edge of skate 160 toward the center thereof. This has the result of locating the bearing contact between skate 160 and guide surface 156 near the outer edge of skate 160 which, in turn, has the effect of dispersing the load. As shown in FIG. 5, the neighboring bearing means 178 is similarly disposed with an angular inclination from the opposite outer edge of skate 160 toward the center thereof so that the location of bearing contact between skate 160 and guide surface is near that opposite edge of skate 160 for load dispersion. For each of the bearing means, the foregoing angular disposition or inclination is provided by so disposing or inclining the inner surface of the bearing receiving recess, i.e. surface 182.

Figure 7:
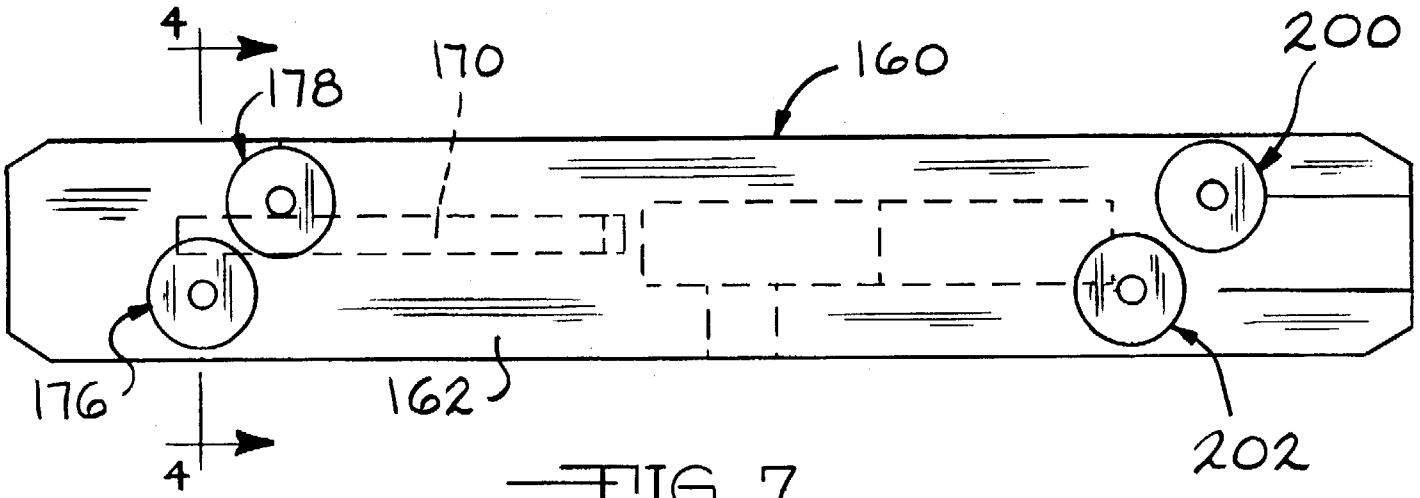
FIG. 7 is a plan view of the improved skate according to the present invention and showing the plurality of movable bearing means in the operative surface of the skate.

FIG. 7 illustrates the arrangement of a plurality of bearing means along operative surface 162 of skate means 160. In the skate shown, there are four bearing means along the length thereof, i.e. bearing means 176 and 178 previously described plus the two bearing means designated 200 and 202 in FIG. 7. In addition, the bearing means are arranged in pairs near the opposite ends of skate 160 for the purpose of dispersing the load. Within each pair, the bearing means are in axially offset relation to accommodate the distance between the sides of skate 160.

The preferred form of bearing means 176, 178, 200 and 202 is needle thrust bearings, although other suitable bearings can be employed. For example, while ball bearings might be utilized, needle thrust bearing are preferred because of their greater bearing surface area. By way of example, in an illustrative end cutter skate, each bearing means 176, 178, 200 and 202 is type SKF #AXK-0515 needle roller thrust bearing with nylon retainer wherein housing 180 has an outer diameter of 0.590 inch, opening 188 has a diameter of 0.078 inch and each roller 186 has a diameter of 0.078 inch. Wear disc 190 preferably is 0.012 inch thick 1095 spring steel having a diameter of 0.578 inch. Wear strip 194 preferably is 0.012 inch thick 1074 spring steel having a width of 1.125 inch.

It is therefore apparent that the present invention accomplishes its intended objects. There is provided a new and improved skate 160 for an end cutter apparatus for cutting sheet material such as cloth. The provision of movable bearing means in skate 160 significantly reduces friction between the skate and the end cutter track along which the skate member slides. In a manual type of end cutter this, in turn, reduces effort and strain or wear on the arm of the person operating the end cutter. In an automatic type of end cutter the foregoing, in turn, reduces wear on the drive means and brake in the apparatus. Tests have confirmed a ten-fold increase in wear life of a skate 160 according to the present invention incorporating movable bearing means as compared to a skate such as that shown in FIG. 3 wherein the operative surface is coated with anti-friction material.

While the present invention has been described in detail, that has been done for the purpose of illustration, not limitation.

What is claimed is:

1. An apparatus for cutting sheet material such as cloth as said material lies on a supporting surface having opposite sides, said apparatus comprising elongated track means adapted to extend across said supporting surface between said sides, said track means having a longitudinal axis, an exposed surface over which said sheet material lies during cutting thereof, a slot extending along the length thereof and a guide surface spaced from said exposed surface facing said slot and extending along said track means in a plane substantially parallel to the longitudinal axis thereof, said apparatus further comprising skate means for sliding along said track means and having an operative surface facing said guide surface of said track means, said skate means being elongated and having a pair of sides, bracket means extending from said skate means through said slot in said track means, blade means carried by said bracket means and extending into said slot for cutting sheet material lying on said exposed surface of said track means as said skate means slides therealong, the improvement comprising:

movable bearing means mounted in said skate means on said operative surface thereof for providing bearing contact between said skate means and said guide surface of said track means as said skate means slides along said track means, said movable bearing means comprising a needle roller thrust bearing including a body and a plurality of rollers rotatably received therein, said body being generally disc shaped and said rollers extending radially between the center and the periphery of said body, and said bearing means being disposed at a small inclined angle from one of said sides toward a central longitudinal axis of said skate means.

2. An apparatus for cutting sheet material such as cloth as said material lies on a supporting surface having opposite sides, said apparatus comprising elongated track means adapted to extend across said supporting surface between said sides, said track means having a longitudinal axis, an exposed surface over which said sheet material lies during cutting thereof, a slot extending along the length thereof and a guide surface spaced from said exposed surface facing said slot and extending along said track means in a plane substantially parallel to the longitudinal axis thereof, said apparatus further comprising skate means for sliding along said track means and having an operative surface facing said guide surface of said track means, bracket means extending from said skate means through said slot in said track means, blade means carried by said bracket means and extending into said slot for cutting sheet material lying on said exposed surface of said track means as said skate means slides therealong, the improvement comprising:

movable bearing means mounted in said skate means on said operative surface thereof for providing bearing contact and reduced friction between said skate means and said guide surface of said track means as said skate means slides along said track means, said movable bearing means comprising thrust bearing means having a body including a surface carrying a plurality of movable bearing element and disposed so that a plane passing through said body substantially parallel to said body surface is disposed at a slight angle of inclination with respect to said guide surface.

3. Apparatus according to claims 1 or 2, including a plurality of said movable bearing means in said skate means.

4. Apparatus according to claims 1 or 2, wherein said skate means is elongated having first and second ends and wherein there is provided a plurality of said movable bearing means, at least one of said movable bearing means being located in said operative surface near each of said first and second ends of said skate means.

5. Apparatus according to claims 1 or 2, wherein a pair of said movable bearing means is located near each of said first and second ends of said skate means.

6. Apparatus according to claims 1 or 2, further including a wear strip extending along said guide surfaces of said track means, said bearing means having bearing contact with said wear strip.

7. Apparatus according to claims 1 or 2, including means for manually moving said skate means and said bracket means along said track means.

8. Apparatus according to claims 1 or 2, including means for automatically moving said skate means and said bracket means along said track means.

9. Apparatus according to claims 1 or 2 wherein said blade means is operatively connected to motor means carried by said bracket means.

* * * * *